United States Patent [19]

Salerno

[11] Patent Number: 4,902,013

[45] Date of Patent: Feb. 20, 1990

[54] LOTTERY NUMBER SELECTION DEVICE

[76] Inventor: Ronald E. Salerno, 851 Pauline Ave., Columbus, Ohio 43224

[21] Appl. No.: 268,062

[22] Filed: Nov. 7, 1988

[51] Int. Cl.[4] ..... A63F 7/04

[52] U.S. Cl. ..... 273/138 R; 273/144 B

[58] Field of Search ..... 273/115, 144 R, 144 A, 273/144 B, 138 R

[56] References Cited

U.S. PATENT DOCUMENTS

| | | | |
|---|---|---|---|
| 3,237,949 | 3/1966 | Chamberlin | 273/144 B |
| 3,423,872 | 1/1969 | Dodson | 273/144 B UX |
| 4,403,775 | 9/1983 | Chaput | 273/144 B |
| 4,498,671 | 2/1985 | Kostow | 273/144 B |
| 4,807,881 | 2/1989 | Jaquez | 273/144 B |
| 4,807,882 | 2/1989 | Cimino | 273/144 B |

FOREIGN PATENT DOCUMENTS

| | | | |
|---|---|---|---|
| 1480344 | 4/1967 | France | 273/144 B |
| 1418690 | 12/1975 | United Kingdom | 273/138 R |

*Primary Examiner*—Anton O. Oechsle
*Attorney, Agent, or Firm*—Leon Gilden

[57] ABSTRACT

A lottery number selection device is set forth wherein a transparent case slidingly accepts planar insert therewithin. The insert is provided with a plurality of upstanding flexible tips at a distal end thereof adjacent an outwardly extending stem portion. A plurality of inserts is contemplated in corresponding to a like number of States utilizing a lottery for income gathering purposes. Each State insert includes a number of hemispherical recesses corresponding to the number of single and multi digit potential numbers utilized in a lottery number. A number of spherical balls corresponding to the number of single and multi-digit numbers selected in a lottery number selection procedure. The number of balls may be deleted or added from interiorly of the case to correspond to the numbers to be selected.

6 Claims, 1 Drawing Sheet

10
11
11a
11b
12
13
14
15
15a
16
17
18
19
20
21
22

LOTTERY NUMBER SELECTION DEVICE

BACKGROUND OF THE INVENTION

1. Field of the Invention

The field of invention relates to lottery games, and more particularly pertains to a new and improved lottery number selection device wherein an individual may randomly utilize a game board to select a series of single and two digit numbers of a group utilized in lottery games.

2. Description of the Prior Art

The wide spread implementation of lottery games by various jurdisdictions is well established. While various games of chance utilizing spherical balls deposited within projections and the like is well known in the prior art, there has heretofore been unavailable a game for assisting in the random selection of a series of digits, as typically utilized in various jurisdictional States. For example, U.S. Pat. No. 3,237,949 to Chamberlin sets forth a game of chance wherein a housing includes a plurality of shallow pockets on a planar panel with a spring underlying said panel and a casing with a button to push the panel against the spring to reposition the balls and provide a random positioning of the balls within the associated sockets.

U.S. Pat. No. 3,423,872 to Dodson sets forth a transparent sphere with rotating balls positionable therewithin wherein the balls may be manually repositioned within the sphere utilizing a projecting handle therefrom with a passageway directed from the sphere to the handle to enable a one-way passage of the ball therethrough.

U.S. Pat. No. 3,679,211 to Hartley sets forth an elongate box configuration with transparent top including a planar portion and a second portion including a plurality of recesses for securement of spherical balls therewithin that upon tilting of the housing, the spherical balls are positioned in a random manner within the recesses.

U.S. Pat. No. 4,373,728 to Korzenietz sets forth a device for random number selector wherein a shaft is secured to a rotatable wheel provided with recesses at its periphery thereof whereupon rotation of the wheel, a spherical ball from an overlying magazine to be deposited within the aforenoted recesses.

U.S. Pat. No. 4,403,775 to Chaput sets forth another random number selector utilizing a plurality of spheres of contrasting colors wherein upon depositing of the balls from a first portion of a magazine into a second portion, balls of a predetermined coloration will be in overlying position to a random number of digits to provide a random digit selection.

U.S. Pat. No. 4,498,671 to Kostow sets forth a device for random number selection in a lottery game wherein a cube contains a group of balls corresponding in number to a number of lottery card grid numbers to be selected wherein the cube utilizing six faces provides a random selection of numbers by a shaking of the cube containing the number of the balls therewithin and by selecting one of the six faces of the cube to effect positioning of the sphere within random spaces within that face of the cube.

As such, it may be appreciated that there is continuing need for a new and improved lottery number selection device which addresses both the problem of convenience and ease of use, and in this respect, the present invention substantially fulfills this need.

SUMMARY OF THE INVENTION

In view of the foregoing disadvantages inherent in the known types of random number selection devices now present in the prior art, the present invention provides a lottery number selection device wherein the same may be conveniently programmed to associate with a predetermined jurisdictional State and conveniently utilized to effect random number selection. As such, the general purpose of the present invention, which will be described subsequently in greater detail, is to provide a new and improved lottery number selective device which has all the advantages of the prior art random number selection devices and none of the disadvantages.

To attain this, the present invention comprises a transparent housing including a plurality of underlying tabs defining a receiving slot for accepting of a planar insert therewithin wherein the insert is one of a plurality of inserts to correspond to a jurisdictional State and the recesses within the insert corresponding to the typical digit selection within that State. A removable plug is positioned within the housing for increasing or decreasing the number of spheres utilized to correspond with the number of two digit numbers utilized in the lottery number. A plurality of upstanding flexible tips are orthogonally secured to an uppermost portion of the insert for securing the insert interiorly of the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phaseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lottery number selection device which has all the advantages of the prior art lottery number selection devices and none of the disadvantages.

It is another object of the present invention to provide a new and improved lottery number selection device which may be easily and efficiently manufactured and marketed.

It is a further object of the present invention to provide a new and improved lottery number selection device which is of a durable and reliable construction.

An even further object of the present invention is to provide a new and improved lottery number selection device which is susceptible of a low cost of manufacture with regard to both materials and labor, and which accordingly is then susceptible of low prices of sale to the consuming public, thereby making such lottery number selection device economically available to the buying public.

Still yet another object of the present invention is to provide a new and improved lottery number selection device which provides in the apparatuses and methods of the prior art some of the advantages thereof, while simultaneously overcoming some of the disadvantages normally associated therewith.

Still another object of the present invention is to provide a new and improved lottery number selection device wherein the same may be programmed to correspond to a predetermined jurisdictional State wherein a transparent housing provides a slot for removably selecting inserts corresponding to a lottery number related to a particular jurisdictional State.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4, 5, 5A, 6:
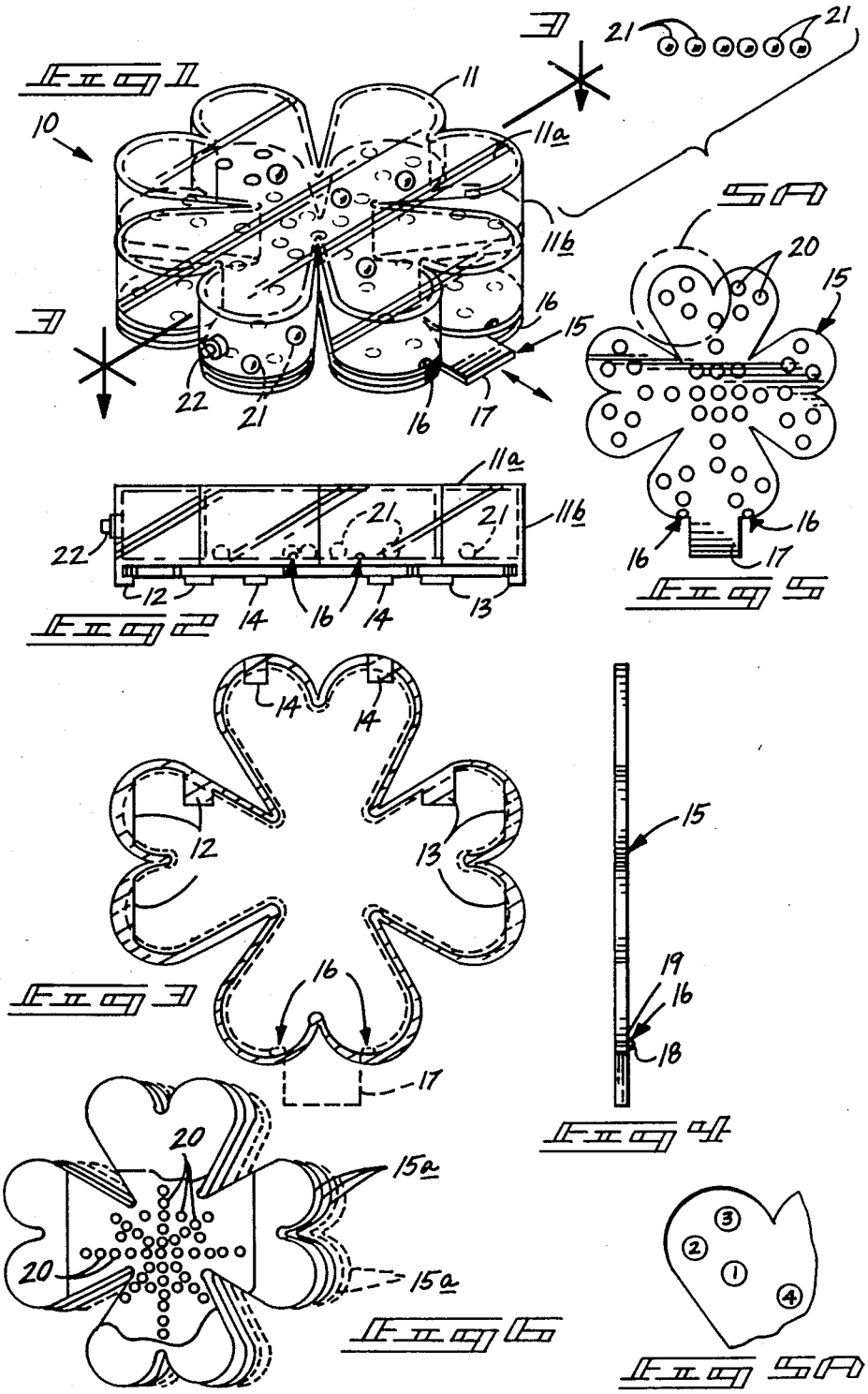
FIG. 1 is an isometric illustration of the instant invention.
FIG. 2 is an orthographic view taken in elevation of the instant invention.
FIG. 3 is an orthographic view taken along the lines 3—3 of FIG. 1 in the direction indicated by arrows.
FIG. 4 is a side orthographic view of the insert utilized in the instant invention.
FIG. 5 is a top orthographic view of a typical insert utilized by the instant invention.
FIG. 5*a* is a top orthographic enlarged view as set forth in FIG. 5 illustrating typical numbered depressions.
FIG. 6 is a top orthographic illustration of an example of an insert utilized with a particular jurisdictional State.

With reference now to the drawings, and in particular to FIGS. 1 to 6 thereof, a new and improved lottery number selection device embodying the principles and concepts of the present invention and generally designated by the reference numeral 10 will be described.

More specifically, it will be noted that the lottery number selection device 10 essentially comprises a transparent housing 11 formed with a planar top service 11*a* and a downwardly depending continuous side wall 11*b*. The housing is open at the bottom and includes a first trio of tabs 12 on the side of the housing projecting generally orthogonally to the side wall 11*b* and parallel to the top 11*a*. Similarly, the left side of the housing includes a trio of second tabs 13 with a plurality of forward third tabs 14 positioned forwardly and medially between the first and second tabs 12 and 13 respectively. The tabs are spaced below the side wall a distance equal to the thickness of a planar insert 15. The planar insert 15 upon positionment within the slot formed by the spacing of the various tabs 12, 13, and 14 below the side wall 11*b* totally encloses the housing 11. The planar insert 15 is also of a complementary configuration to that defined by the perimeter of the side walls 11*b*.

Positioned orthogonally extending outwardly of the insert 15 is a stem 17 for manual grasping and positioning of the insert interiorly and exteriorly of the housing 11. A plurality of upwardly projecting flexible tips 16 are positioned on either side of the handle 17 and adjacent the forward extent of handle 17 whereupon positioning of the planar insert 15 within the housing 11, the flexible tip 16 will be forced into engagement within an interior surface of a rear side wall portion of the side wall 11*a*, as illustrated in FIG. 3 for example. The flexible tips 16 are formed with an arcuate forward surface 19 for ease of entry past a lower terminal end of the side wall 11*a* wherein the flexible tips 16 are provided with a rear facing planar surface 18 for engagement with the interior surface of the wall 11*a*, as noted.

The planar insert 15 is formed with a matrix of numbered recesses 20 wherein each of said recesses is arranged of a complementary configuration to receive a sphere 21. The number of spheres may be changed while the planar insert 15 is positioned within the housing 11 by the use of a removable plug 22 removably secured within a through extending aperture in a side wall of the housing 11.

FIG. 6 illustrates a further modification of a planar insert 6 wherein a series of such planar inserts are provided in conformity with a like number of States utilizing a sanctioned lottery revenue producing game within the jurisdictional State. Accordingly, each planar insert 15, 15*a*, etc., may provide a configuration equal to the boundary configuration of the State in question and position the various hemispherical recesses 20 therewithin, as illustrated in FIG. 6 for example. The number of spheres may vary from State to State wherein it is noted that typically six numbers of potentially one or two digit designation are utilized, such as in Ariz., six numbers out of thirty-nine potential numbers are utilized ranging from zero-one to thirty-nine. A further example is Calif. wherein six digits ranging from zero-one to forty-nine are utilized. Accordingly, each of the planar inserts will contain a like number of potential hemispherical recesses corresponding to the State in question, such as an insert 15*a* corresponding the State of Ohio will be provided with forty-four recesses 20 wherein each recess will be provided a number designation from zero-one to forty-four. In use, therefore then, the six spheres will be randomly shaken manually by a user of the device and the six recesses that the spheres land in will provide the six numbers for selection by an individual. The proper sequencing of the numbers randomly selected by the positioning of the various spheres within the recesses 20 may be effected by numbering the spheres from one to six or providing different colorations on the spheres to provide a predetermined sequencing of numbers so selected.

The manner of usage and operation therefore of the instant invention may be apparent from the above description and accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A lottery number selection device for selecting a random series of numbers from a finite group, said device comprising, a transparent housing means for enabling visual observation of an interior defined by said housing, and said housing including a top, sides, and projection means underlying said sides for slotting securement of a bottom member, said bottom member including a plurality of numbered depressions, and a further plurality of spheres wherein said plurality of depressions substantially exceeds the further plurality of spheres wherein said spheres are selectively positionable within said housing and, wherein said bottom member is of a like configuration to said top, and further includes a stem extending outwardly of said bottom member and projects outwardly of said housing when said bottom member is positioned within said housing.

2. A lottery number selection device as set forth in claim 1 wherein said bottom member further includes a plurality of flexible tips orthogonally secured to a top surface of said bottom member adjacent said stem.

3. A lottery number selection device as set forth in claim 2 wherein said flexible tips include an arcuate forward surface and a planar rearward surface wherein said planar rearward surface is orthogonally oriented relative to the top surface of said bottom member.

4. A lottery number selection device as set forth in claim 3 wherein said flexible tips and said depressions are both on said top surface of said bottom member.

5. A lottery number selection device as set forth in claim 4 wherein said projection means includes a plurality of individual projections orthogonally oriented relative to the sides of said housing and parallel to the top of said housing.

6. A lottery number selection device as set forth in claim 5 wherein the number of depressions equals a number of whole number digits defining said group and the further plurality of spheres equals the number of whole numbers utilized in a jurisdictional State for determining a lottery number series.

* * * * *